US009153167B2

(12) United States Patent
Choi

(10) Patent No.: US 9,153,167 B2
(45) Date of Patent: Oct. 6, 2015

(54) ORGANIC LIGHT EMITTING DISPLAY CAPABLE OF DISPLAYING AN IMAGE WITH DESIRED BRIGHTNESS

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 569 days.

(21) Appl. No.: 13/091,954

(22) Filed: Apr. 21, 2011

(65) Prior Publication Data

US 2012/0105387 A1 May 3, 2012

(30) Foreign Application Priority Data

Oct. 28, 2010 (KR) ..... 10-2010-0105793

(51) Int. Cl.
*G09G 3/32* (2006.01)

(52) U.S. Cl.
CPC ..... *G09G 3/3225* (2013.01); *G09G 3/3266* (2013.01); *G09G 2300/0439* (2013.01); *G09G 2310/0262* (2013.01); *G09G 2310/0297* (2013.01); *G09G 2320/0233* (2013.01); *G09G 2320/045* (2013.01)

(58) Field of Classification Search
CPC ..... G09G 3/3233; G09G 2300/0819
USPC ..... 345/80, 204; 315/169.3
See application file for complete search history.

(56) References Cited

U.S. PATENT DOCUMENTS

2008/0106504 A1* 5/2008 Wei et al. ..... 345/82
2008/0211397 A1* 9/2008 Choi ..... 313/504
2009/0218937 A1 9/2009 Lee
2009/0225011 A1* 9/2009 Choi ..... 345/77
2009/0309816 A1* 12/2009 Choi ..... 345/76
2010/0117939 A1* 5/2010 Lee ..... 345/76
2010/0127956 A1 5/2010 Kang et al.

FOREIGN PATENT DOCUMENTS

CN 101520983 A 9/2009
CN 101739947 A 6/2010
KR 10-2005-0005646 A 1/2005
KR 10-2006-0135749 A 12/2006
KR 10-2008-0060967 A 7/2008

OTHER PUBLICATIONS

Machine based English translation of Korean Publication 10-2008-0060967 submitted in Applicant's IDS of Apr. 21, 2011.*
SIPO Office action dated Dec. 3, 2014, for corresponding Chinese Patent application 201110195023.9, (9 pages).

* cited by examiner

*Primary Examiner* — Chanh D. Nguyen
*Assistant Examiner* — John Kirkpatrick
(74) *Attorney, Agent, or Firm* — Christie, Parker & Hale, LLP

(57) ABSTRACT

An organic light emitting display capable of displaying an image with desired brightness. The organic light emitting display includes a scan driver for supplying a first scan signal to first scan lines, for supplying a second scan signal to second scan lines, and for supplying emission control signals to emission control lines, a data driver for supplying data signals to data lines, horizontal power source lines extending in parallel with the first scan lines at horizontal lines, and configured to receive a fourth voltage in a first period of a period in which the first scan signal is supplied, and configured to receive a third voltage that is lower than the fourth voltage in a second period excluding the first period, and pixels positioned at crossing regions of the first scan lines and the data lines. Each of the pixels includes an OLED, a first transistor, and a storage capacitor.

7 Claims, 6 Drawing Sheets

ORGANIC LIGHT EMITTING DISPLAY CAPABLE OF DISPLAYING AN IMAGE WITH DESIRED BRIGHTNESS

CROSS-REFERENCE TO RELATED APPLICATION

This application claims priority to and the benefit of Korean Patent Application No. 10-2010-0105793, filed on Oct. 28, 2010, in the Korean Intellectual Property Office, the entire content of which is incorporated herein by reference.

BACKGROUND

1. Field

Embodiments of the present invention relate to an organic light emitting display.

2. Description of Related Art

Recently, various flat panel displays (FPDs) capable of reducing weight and volume that are disadvantages of cathode ray tubes (CRTs) have been developed. The FPDs include liquid crystal displays (LCDs), field emission displays (FEDs), plasma display panels (PDPs), and organic light emitting displays.

Among the FPDs, organic light emitting displays display images using organic light emitting diodes (OLEDs) that generate light by re-combination of electrons and holes. Organic light emitting displays have high response speed and are driven with low power consumption.

Organic light emitting displays include pixels positioned at crossing regions of data lines and scan lines, a data driver for supplying data signals to data lines, and a scan driver for supplying scan signals to scan lines.

The scan driver sequentially supplies scan signals to scan lines. The data driver supplies data signals to data lines in synchronization with the scan signals.

The pixels are selected when the scan signals are supplied to the scan lines to receive the data signals from the data lines. At this time, the storage capacitors included in the pixels charge voltages corresponding to the data signals, and driving transistors control an amount of current supplied from a first power source to a second power source via organic light emitting diodes (OLEDs) according to the voltages charged in the storage capacitors.

SUMMARY

Accordingly, embodiments of the present invention provide an organic light emitting display capable of displaying an image with desired brightness.

To achieve the foregoing and/or other aspects of embodiments of the present invention, there is provided an organic light emitting display including a scan driver for supplying a first scan signal to first scan lines, for supplying a second scan signal to second scan lines, and for supplying emission control signals to emission control lines, a data driver for supplying data signals to data lines, horizontal power source lines extending in parallel with the first scan lines at horizontal lines, and configured to receive a fourth voltage in a first period of a period in which the first scan signal is supplied, and configured to receive a third voltage that is lower than the fourth voltage in a second period excluding the first period, and pixels positioned at crossing regions of the first scan lines and the data lines, wherein each of the pixels includes an organic light emitting diode (OLED), a first transistor for controlling an amount of current that flows from a first power source to a second power source via the OLED in accordance with the data signals, and a storage capacitor coupled between a gate electrode of the first transistor and a corresponding one of the horizontal power source lines.

The third voltage may be lower than a voltage of the data signals.

The fourth voltage may be higher than a voltage of the data signals.

The fourth voltage may be the same as a voltage of the first power source.

The data driver may be configured to supply the data signals to the data lines in synchronization with the first scan signal.

The organic light emitting display may further include a first power source line coupled to a third power source for supplying the third voltage, a second power source line coupled to a fourth power source for supplying the fourth voltage, first switching elements coupled between the first power source line and the horizontal power source lines, and second switching elements coupled between the second power source line and the horizontal power source lines.

A second switching element from among the second switching elements positioned at an $i^{th}$ (i is a natural number) horizontal line of the horizontal lines may be configured to be turned on for the first period, and a first switching element from among the first switching elements positioned at the $i^{th}$ horizontal line may be configured to be turned on for a time longer than that of the second period and including the second period.

The second switching element positioned at the $i^{th}$ horizontal line may be configured to be turned on when the second scan signal is supplied to an $i^{th}$ second scan line of the second scan lines.

The organic light emitting display may further include a switching driver for sequentially supplying control signals to control lines extending in parallel with the first scan lines.

The first switching element positioned at the $i^{th}$ horizontal line may be configured to be turned on when a control signal of the control signals is supplied to an $i^{th}$ control line of the control lines.

The scan driver may be configured to supply an emission control signal to an $i^{th}$ emission control line to overlap the first scan signal supplied to an $i^{th}$ first scan line of the first scan lines.

The emission control signal may be set to have a larger width than that of the first scan signal.

Each of the pixels may further include a second transistor and a third transistor that are serially coupled between a first electrode of the first transistor and the horizontal power source lines and are configured to be turned off when an emission control signal of the emission control signals is supplied, and a fourth transistor coupled between a second electrode of the first transistor and the OLED and configured to be turned off when the emission control signal is supplied.

The first power source may be coupled to a common node between the second transistor and the third transistor.

Each of the pixels may further include a fifth transistor coupled between the first electrode of the first transistor and a data line of the data lines and configured to be turned on when the first scan signal is supplied, a sixth transistor coupled between the first electrode of the first transistor and the gate electrode of the first transistor and configured to be turned on when the second scan signal is supplied, and a seventh transistor coupled between the gate electrode of the first transistor and the second electrode of the first transistor and configured to be turned on when the first scan signal is supplied.

Each of the pixels may further include a fifth transistor coupled between the second electrode of the first transistor and the data line and configured to be turned on when the first scan signal is supplied, a sixth transistor coupled between the second electrode of the first transistor and the gate electrode of the first transistor and configured to be turned on when the second scan signal is supplied, and a seventh transistor coupled between the gate electrode of the first transistor and the first electrode of the first transistor and configured to be turned on when the first scan signal is supplied.

The organic light emitting display may further include demultiplexers coupled between output lines of the data driver and the data lines.

Each of the demultiplexers may include switching elements respectively coupled to the data lines.

The switching elements may be sequentially turned on during the first period.

In organic light emitting displays according to embodiments of the present invention, since the gate electrodes of the driving transistors are initialized by the voltages of the data signals, it is possible to display an image with uniform brightness. In addition, according to embodiments of the present invention, the voltages of the gate electrodes of the driving transistors may be controlled using the storage capacitors without additional initializing wiring lines.

BRIEF DESCRIPTION OF THE DRAWINGS

The accompanying drawings, together with the specification, illustrate exemplary embodiments of the present invention, and, together with the description, serve to explain aspects of the present invention.

DETAILED DESCRIPTION

Figure 1:
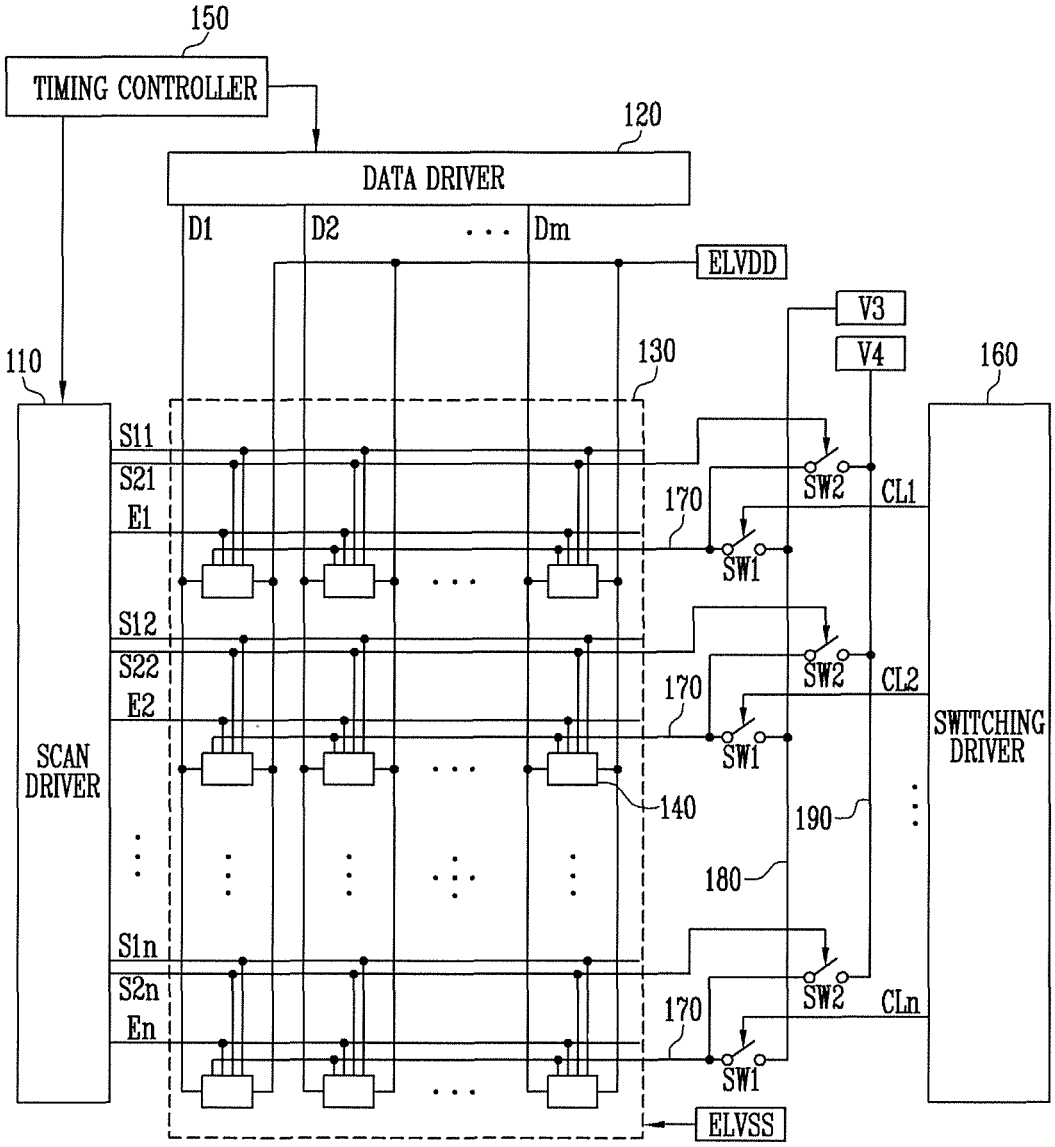
FIG. 1 is a schematic diagram illustrating an organic light emitting display according to an embodiment of the present invention.

In an organic light emitting display, threshold voltages of the driving transistors may be stored in storage capacitors in order to minimize variation in the threshold voltages of the driving transistors included in the pixels. The pixels may include a structure in which the driving transistors are coupled to each other in the form of a diode, and initializing voltages lower than data signals may be supplied to the gate electrodes of the driving transistors so that the driving transistors coupled in the form of a diode may be turned on.

When the pixels are constructed as described above, the threshold voltages of the driving transistors may be compensated for. However, wiring lines are additionally formed between an initial power source and the gate electrodes of the driving transistors in order to supply the initializing voltages. In addition, since the gate electrodes of the driving transistors are initialized by the initializing voltages regardless of gray levels to be displayed, it may not be possible to display an image with uniform brightness.

For example, the gate electrodes of the driving transistors may be initialized by the same voltage regardless of the gray levels to be displayed. In this case, the voltages of the gate electrodes of the driving transistors should be changed from the initializing voltages to the voltages of the data signals within a determined time (for example, 1H, or one horizontal period). However, since the data signals are set to have different voltage values for different gray levels so that the voltages to be changed are set to vary every pixel, it may not be possible to display an image with uniform brightness.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more other elements. Further, some of the elements that are not essential to a complete understanding of the invention are omitted for clarity. Also, like reference numerals refer to like elements throughout.

Embodiments by which those skilled in the art may perform the present invention without undue experimentation will be described with reference to FIGS. 1 to 6.

FIG. 1 is a schematic diagram illustrating an organic light emitting display according to an embodiment of the present invention.

Referring to FIG. 1, the organic light emitting display according to an embodiment of the present invention includes a display unit 130 including pixels 140 positioned at the crossing regions of first scan lines S11 to S1*n* and data lines D1 to Dm, a scan driver 110 for driving the first scan lines S11 to S1*n*, second scan lines S21 to S2*n*, and emission control lines E1 to En, a data driver 120 for driving the data lines D1 to Dm, and a timing controller 150 for controlling the scan driver 110 and the data driver 120.

In addition, the organic light emitting display according to one embodiment of the present invention includes horizontal power source lines 170 formed to run substantially parallel (e.g., extend parallel or substantially parallel) with the first scan lines S11 to S1*n* in every horizontal line to be coupled to the pixels 140, a first power source line 180 coupled to a third power source V3 outside of the display unit 130, a second power source line 190 coupled to a fourth power source V4 outside of the display unit 130, first switching elements SW1 coupled between the horizontal power source lines 170 and the first power source line 180, second switching elements SW2 coupled between the horizontal power source lines 170 and the second power source line 190, and a switching driver 160 for supplying control signals to control lines CL1 to CLn.

The scan driver 110 concurrently (e.g., sequentially) supplies a first scan signal to the first scan lines S11 to S1*n* and sequentially supplies a second scan signal to the second scan lines S21 to S2*n*. The scan driver 110 sequentially supplies emission control signals to emission control lines E1 to En. Here, the first scan signal is set to have a larger width than the second scan signal, and the emission control signals are set to have a larger width the first scan signal.

The scan driver 110 simultaneously supplies the first scan signal supplied to an $i^{th}$ (i is a natural number) first scan line S1*i*, and the second scan signal supplied to an $i^{th}$ second scan line S2*i*. In addition, the scan driver 110 supplies an emission control signal to an $i^{th}$ emission control line Ei to overlap the first scan signal and the second scan signal supplied to the $i^{th}$ first scan line S1*i* and the $i^{th}$ second scan line S2*i*.

The data driver 120 supplies data signals to the data lines D1 to Dm in synchronization with the first scan signal supplied to the first scan lines S11 to S1*n*.

The timing controller 150 controls the scan driver 110 and the data driver 120. The timing controller 150 realigns the externally supplied data to transmit the data to the data driver 120.

The switching driver 160 sequentially supplies control signals to the control lines CL1 to CLn. Here, the switching driver 160 supplies a control signal to an $i^{th}$ control line CLi to not overlap the second scan signal supplied to the $i^{th}$ second scan line S2*i*, but instead to overlap the first scan signal supplied to the $i^{th}$ first scan line S11. That is, when a period in which the first scan signal is supplied is divided into a first period and a second period, the second scan signal is supplied in the first period, and the control signal is supplied for a time longer than, and including (e.g., overlapping with), the second period.

The first power source line 180 is external to the display unit 130 and is coupled to the third power source V3. Here, the third power source V3 is set to have a voltage lower than that of the data signals.

The second power source line 190 is external to the display unit 130, and is coupled to the fourth power source V4. Here, the fourth power source V4 is set to have a voltage higher than that of the data signals, for example, the same voltage as that of a first power source ELVDD.

The horizontal power source lines 170 are formed every horizontal line to be coupled to the pixels 140. The horizontal power source lines 170 are coupled to the third power source V3 when the first switching elements SW1 are turned on, and the horizontal power source lines 170 are coupled to the fourth power source V4 when the second switching elements SW2 are turned on.

The first switching elements SW1 are coupled between the horizontal power source lines 170 and the first power source line 180. The first switching elements SW1 are turned on and off in accordance with the control signals.

The second switching elements SW2 are coupled between the horizontal power source lines 170 and the second power source line 190. The second switching elements SW2 are turned on and off to alternate with the first switching elements SW1 corresponding to the second scan signal.

The display unit 130 includes the pixels 140 positioned at the crossing regions of the first scan lines S11 to S1*n* and the data lines D1 to Dm. The pixels 140 generate light components with brightness components (e.g., predetermined brightness components) corresponding to the data signals.

Figure 2:
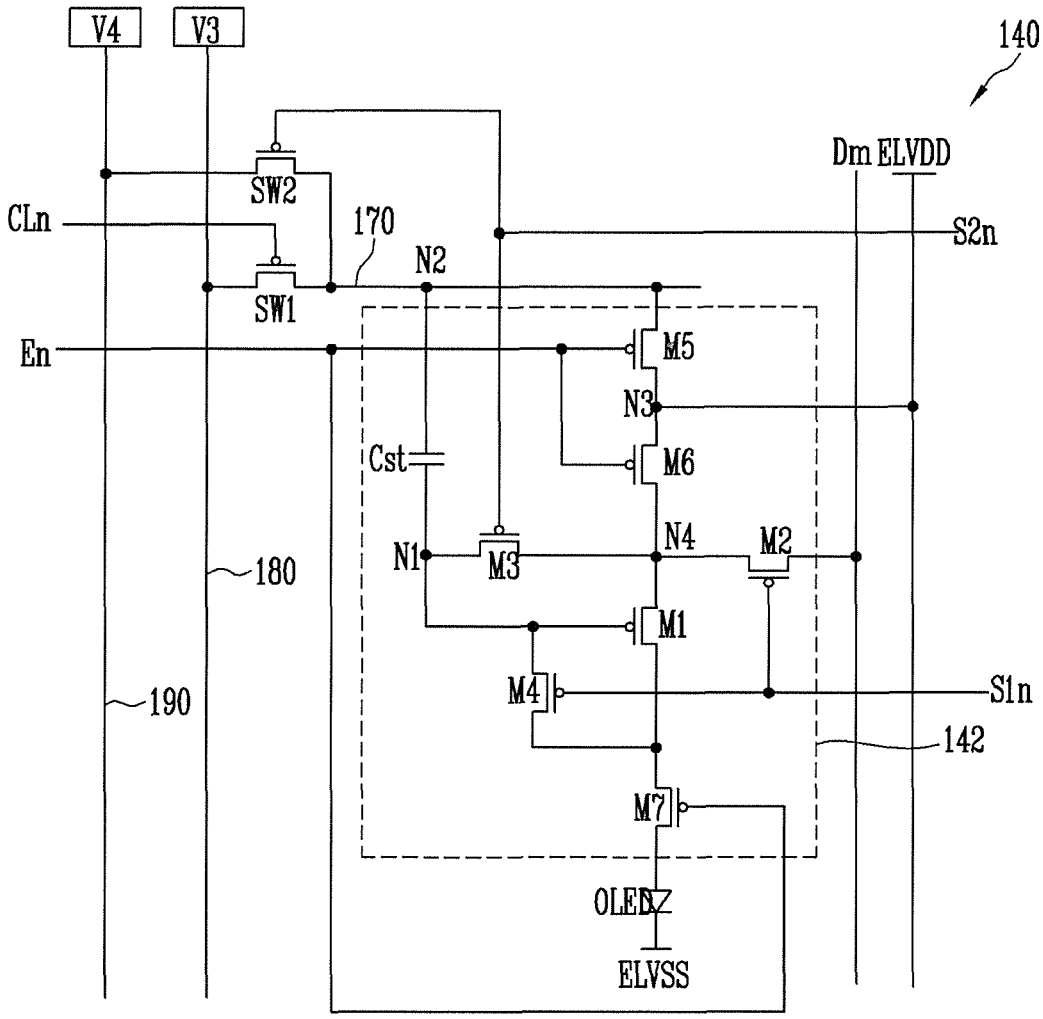
FIG. 2 is a circuit diagram illustrating an embodiment of a pixel of the organic light emitting display of the embodiment shown in FIG. 1.

FIG. 2 is a circuit diagram illustrating an embodiment of the pixel 140 shown in FIG. 1.

Referring to FIG. 2, the pixel 140 according to one embodiment of the present invention includes an organic light emitting diode (OLED) and a pixel circuit 142 for controlling an amount of current supplied to the OLED.

An anode electrode of the OLED is coupled to the pixel circuit 142, and a cathode electrode of the OLED is coupled to a second power source ELVSS. The OLED generates light with brightness (e.g., predetermined brightness) corresponding to the current supplied from the pixel circuit 142.

The pixel circuit 142 controls the amount of current that flows from the first power source ELVDD to the second power source ELVSS via the OLED in accordance with the data signals. Therefore, the pixel circuit 142 includes first to seventh transistors M1 to M7 and a storage capacitor Cst.

A first electrode of the first transistor M1 is coupled to a fourth node N4, and a second electrode of the first transistor M1 is coupled to a first electrode of the seventh transistor M7. A gate electrode of the first transistor M1 is coupled to a first node N1. The first transistor M1 controls the amount of current supplied to the OLED corresponding to the voltage applied to the first node N1.

A first electrode of the second transistor M2 is coupled to the data line Dm and a second electrode of the second transistor M2 is coupled to the fourth node N4. A gate electrode of the second transistor M2 is coupled to the first scan line S1*n*. The second transistor M2 is turned on when the first scan signal is supplied to the first scan line S1*n* to electrically couple the data line Dm to the fourth node N4.

A first electrode of the third transistor M1 is coupled to the fourth node N4 and a second electrode of the third transistor M1 is coupled to the first node N1. A gate electrode of the third transistor M3 is coupled to the second scan line S2*n*. The third transistor M3 is turned on when the second scan signal is supplied to the second scan line S2*n* to electrically couple the first node N1 to the fourth node N4.

A first electrode of the fourth transistor M4 is coupled to the second electrode of the first transistor M1 and a second electrode of the fourth transistor M4 is coupled to the first node N1. A gate electrode of the fourth transistor M4 is coupled to the first scan line S1*n*. The fourth transistor M4 is turned on when the first scan signal is supplied to the first scan line S1*n* to couple the first transistor M1 in the form of a diode.

A first electrode of the fifth transistor M5 is coupled to the horizontal power source line 170 (e.g., at a second node N2), and a second electrode of the fifth transistor M5 is coupled to a third node N3. A gate electrode of the fifth transistor M5 is coupled to the emission control line En. The fifth transistor M5 is turned off when an emission control signal is supplied to the emission control line En, and is turned on otherwise.

A first electrode of the sixth transistor M6 is coupled to the third node N3, and a second electrode of the sixth transistor M6 is coupled to the fourth node N4. A gate electrode of the sixth transistor M6 is coupled to the emission control line En. The sixth transistor M6 is turned off when the emission control signal is supplied to the emission control line En, and is turned on otherwise.

The storage capacitor Cst is coupled between the horizontal power source line 170 and the first node N1. The storage capacitor Cst charges voltages corresponding to the data signals and a threshold voltage of the first transistor M1.

According to the present embodiment, the first power source ELVDD is coupled to the third node N3, which is a common node between the fifth transistor M5 and the sixth transistor M6.

Figure 3:
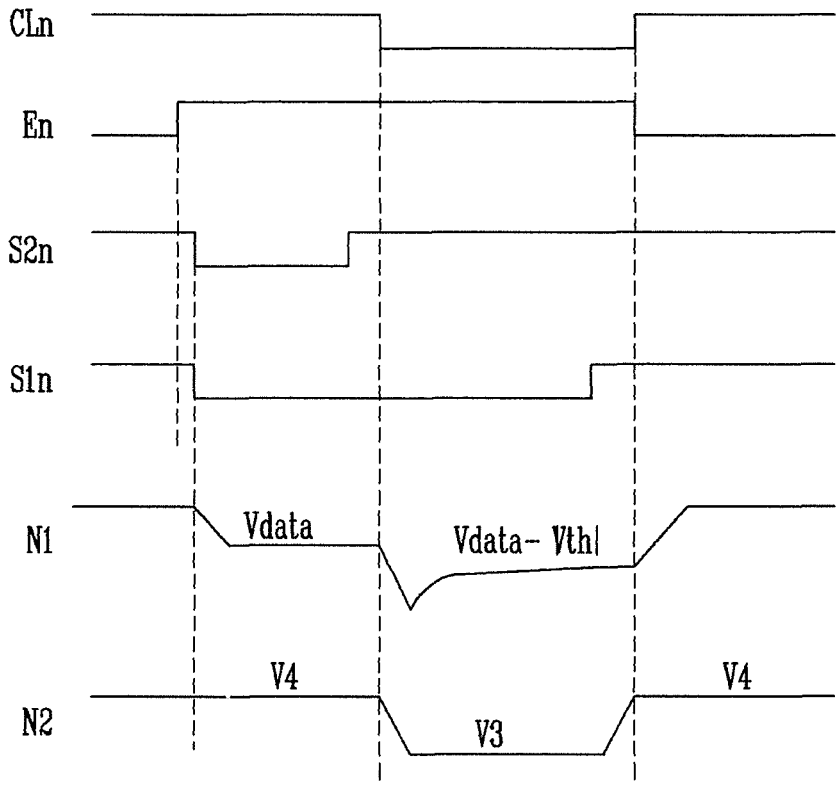
FIG. 3 is a waveform chart illustrating a method of driving the pixel of the embodiment shown in FIG. 2, according to an embodiment of the present invention.

FIG. 3 is a waveform chart illustrating a method of driving the pixel of the embodiment shown in FIG. 2 according to an embodiment of the present invention.

Referring to FIG. 3, first, the emission control signal is supplied to the emission control line En. When the emission control signal is supplied to the emission control line En, the fifth transistor M5, the sixth transistor M6, and the seventh transistor M7 are turned off.

When the fifth transistor M5 and the sixth transistor M6 are turned off, the fourth node N4 (or the third node N3) and the second node N2 are electrically isolated from each other. When the seventh transistor M7 is turned off, the first transistor M1 and the OLED are electrically isolated from each other so that the pixel 140 is in a non-emission state.

Then, the first scan signal is supplied to the first scan line S1*n*, and the second scan signal is supplied to the second scan line S2*n*. When the second scan signal is supplied to the second scan line S2*n*, the second switching element SW2 and the third transistor M3 are turned on. When the second switching element SW2 is turned on, the voltage of the fourth power source V4 is supplied to the horizontal power source line 170. When the third transistor M3 is turned on, the first node N1 and the fourth node N4 are electrically coupled to each other.

When the first scan signal is supplied to the first scan line S1*n*, the second transistor M2 and the fourth transistor M4 are turned on. When the second transistor M2 is turned on, the fourth node N4 and the data line Dm are electrically coupled to each other. In this case, the data signal from the data line Dm is supplied to the fourth node N4 and the first node N1 so that the first node N1 is set to have the voltage Vdata of the data signal. When the fourth transistor M4 is turned on, the first transistor M1 is coupled in the form of a diode.

Then, the supply of the second scan signal to the second scan line S2*n* is stopped, a control signal is supplied to the control line CLn. The supply of the second scan signal is stopped, and the second switching element SW2 and the third transistor M3 are turned off. When the second switching element SW2 is turned off, electric coupling between the horizontal power source line 170 and the fourth power source V4 is blocked. When the third transistor M3 is turned off, electric coupling between the first node N1 and the fourth node N4 is blocked.

When the control signal is supplied to the control line CLn, the first switching element SW1 is turned on. When the first switching element SW1 is turned on, the voltage of the third power source V3 is supplied to the horizontal power source line 170. In this case, the voltage of the horizontal power source line 170 is reduced from the voltage of the fourth power source V4 to the voltage of the third power source V3. When the voltage of the horizontal power source line 170 is reduced, the voltage of the first node N1 is also reduced by a voltage (e.g., a predetermined voltage) from the voltage Vdata of the data signal by the coupling of the storage capacitor Cst.

At this time, since the second transistor M2 is in an on state, the fourth node N4 maintains the voltage Vdata of the data signals. Therefore, the voltage of the first node N1 gradually increases to the voltage obtained by subtracting the threshold voltage of the first transistor M1 from the voltage Vdata of the data signal, and the voltage corresponding to the above mentioned voltage is charged in the storage capacitor Cst. That is, the voltages corresponding to the data signal and the threshold voltage of the first transistor M1 are charged in the storage capacitor Cst.

Then, the supply of the first scan signal to the first scan line S1*n* is stopped so that the second transistor M2 and the fourth transistor M4 are turned off. When the second transistor M2 is turned off, electric coupling between the fourth node N4 and the data line Dm is blocked. When the fourth transistor M4 is turned off, electric coupling between the gate electrode of the first transistor M1 and the second electrode of the first transistor M1 is blocked.

After the second transistor M2 and the fourth transistor M4 are turned off, the supply of the control signal to the control line CLn is stopped, and the supply of the emission control signal to the emission control line En is stopped. The supply of the control signal to the control line CLn is stopped, the first switching element SW1 is turned off so that electric coupling between the horizontal power source line 170 and the third power source V3 is blocked.

When the emission control signal is not supplied to the emission control line En, the fifth transistor M5, the sixth transistor M6, and the seventh transistor M7 are turned on. When the fifth transistor M5 is turned on, the third node N3 and the horizontal power source line 170 are electrically coupled to each other so that the voltage of the first power source ELVDD is supplied to the horizontal power source line 170. At this time, the first node N1 is set to be in a floating state so that the storage capacitor Cst maintains the voltage charged in a previous period.

When the sixth transistor M6 is turned on, the third node N3 and the fourth node N4 are electrically coupled to each other, and the voltage of the first power source ELVDD is supplied to the fourth node N4. When the seventh transistor M7 is turned on, the OLED and the first transistor M1 are electrically coupled to each other. At this time, the first transistor M1 controls the amount of current that flows from the first power source ELVDD to the second power source ELVSS via the OLED according to the voltage charged in the storage capacitor Cst. Then, light corresponding to the amount of current is generated by the OLED.

As described above, according to the present embodiment, the gate electrode of the first transistor M1 is initialized to the voltage Vdata of the data signal. In this case, regardless of the voltages Vdata of the data signals (e.g., gray levels), the voltages of the gate electrodes of the first transistors M1 to be changed in the pixels 140 are the same. Therefore, according to the present embodiment, an image with uniform brightness (e.g., brightness of improved uniformity) may be displayed. In addition, according to the present embodiment, the voltage charged in the storage capacitor Cst is determined regardless of the first power source ELVDD. Therefore, according to the present embodiment, regardless of a voltage reduction of the first power source ELVDD, a desired voltage may be charged in the storage capacitor Cst.

Embodiments of the present invention may include demultiplexers (hereinafter, referred to as demuxes) added between the data driver 120 and the data lines D1 to Dm.

Figure 4:
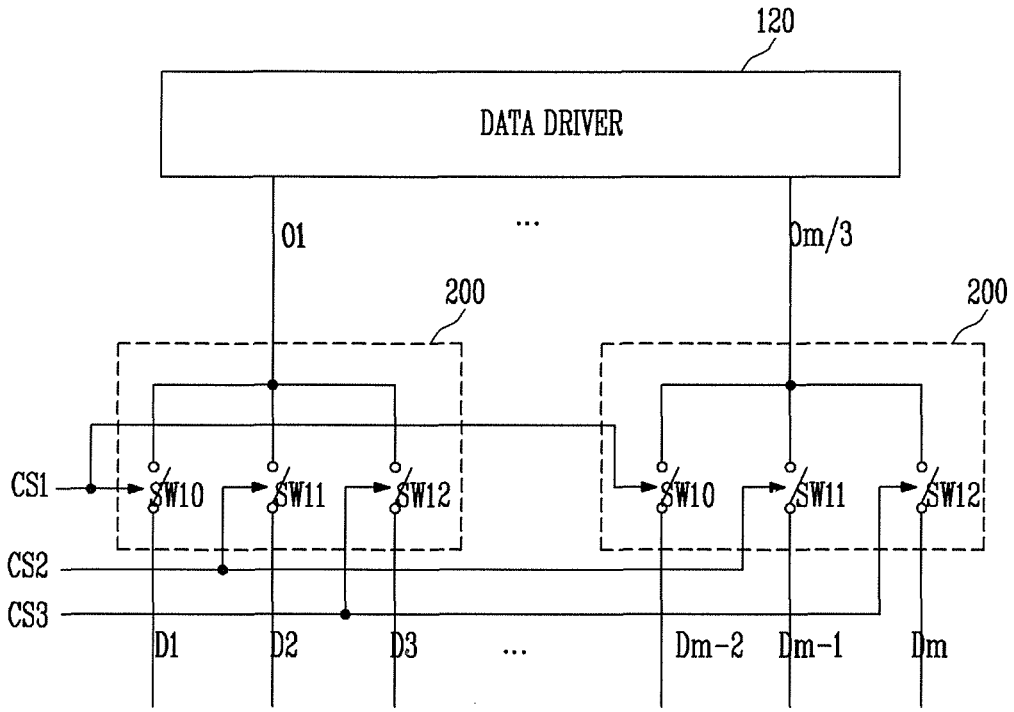
FIG. 4 is a schematic diagram illustrating an embodiment of the present invention in which a demultiplexer is added to the organic light emitting display of the embodiment shown in FIG. 1.

For example, demuxes 200 may be formed in the organic light emitting display to be coupled to the output lines O1 to Om/3 of the data driver 120 as illustrated in FIG. 4.

Each of the demuxes 200 includes a number of switching elements equal to the number of the data lines coupled thereto. For example, when each of the demuxes 200 is coupled to the three data lines, three switching elements SW10, SW11, and SW12 are provided.

The tenth switching element SW10 included in the demux 200 is turned on when a first control signal CS1 is supplied to electrically couple the data lines D1, . . . , and Dm−2 to the output lines O1, . . . , and Om/3, respectively. At this time, the data signals supplied to the output lines O1, . . . , and Om/3 are supplied to the data lines D1, . . . , and Dm−2, respectively.

The eleventh switching element SW11 is turned on when a second control signal CS2 is supplied to electrically couple the data lines D2, . . . , and Dm−1 to the output lines O1, . . . , and Om/3, respectively. At this time, the data signals supplied to the output lines O1, . . . , and Om/3 are supplied to the data lines D2, . . . , and Dm−1, respectively.

The twelfth switching element SW12 is turned on when a third control signal CS3 is supplied to electrically couple the data lines D3, . . . , and Dm to the output lines O1, . . . , and Om/3, respectively. At this time, the data signals supplied to the output lines O1, . . . , and Om/3 are supplied to the data lines D3, . . . , and Dm, respectively.

Figure 5:
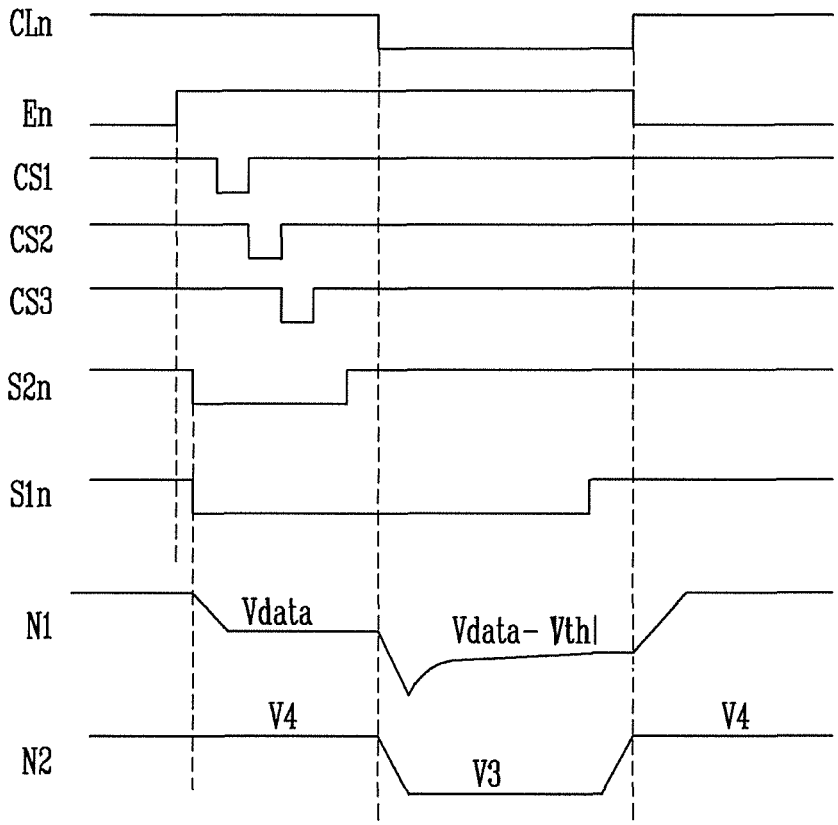
FIG. 5 is a waveform chart illustrating a method of driving the demultiplexer of the embodiment shown in FIG. 4, according to an embodiment of the present invention.

Here, the first control signal to the third control signal CS1 to CS3 are sequentially supplied in a period where the second scan signal is supplied to the second scan line S2*n*, as illustrated in FIG. 5.

That is, in a period where the second scan signal is supplied to the second scan line S2*n* so that the first node N1 and the fourth node N4 of the pixel 140 are coupled to each other, the first control signal to the third control signal CS1 to CS3 are sequentially supplied so that the voltage Vdata of the data signal is applied to the first node N1 of each of the pixels 140. Since the other operation processes are the same as the driving waveform of the embodiment shown in FIG. 3, detailed description will be omitted.

Figure 6:
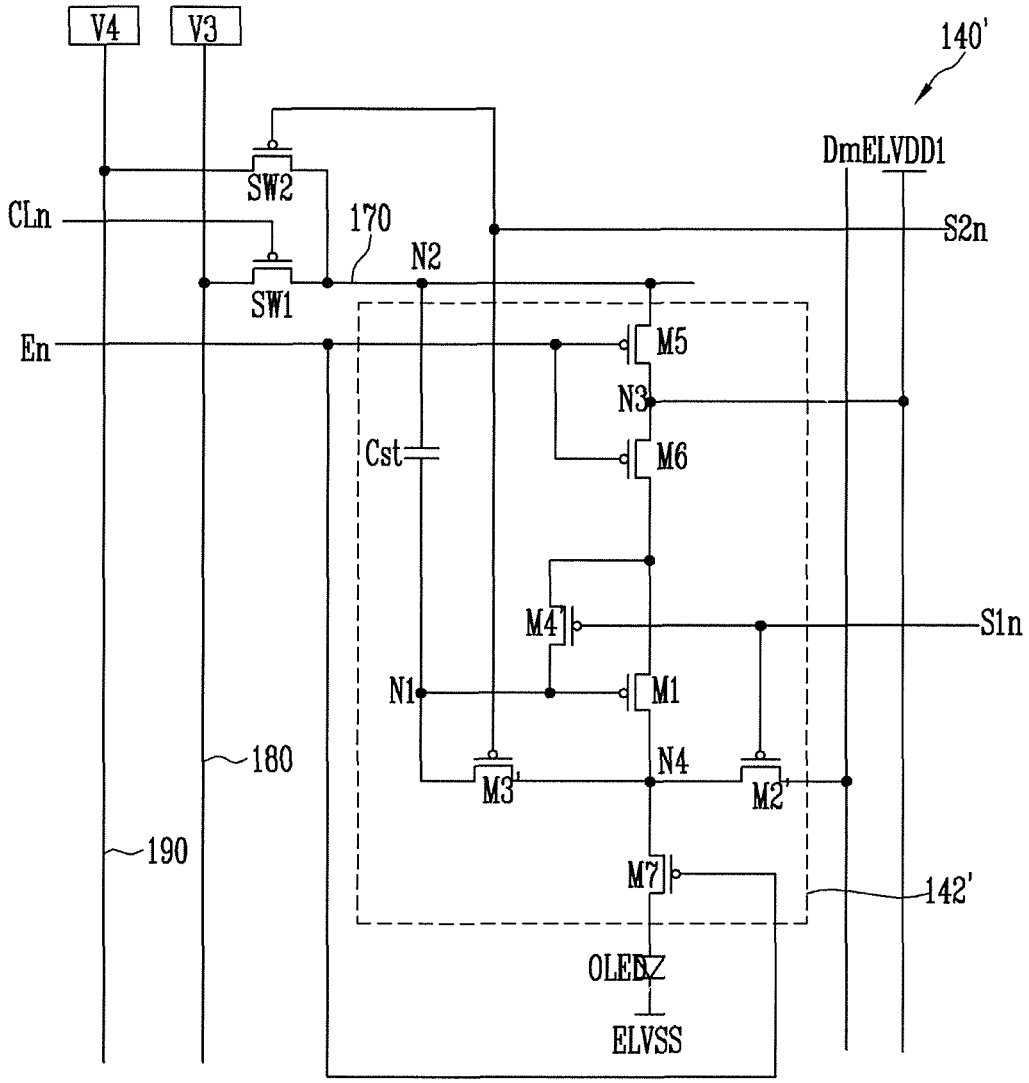
FIG. 6 is a circuit diagram illustrating another embodiment of a pixel of the organic light emitting display of the embodiment shown in FIG. 1.

FIG. 6 is a circuit diagram illustrating a pixel according to another embodiment of the present invention. When FIG. 6 is described, the same elements as those of FIG. 2 are denoted by the same reference numerals, and detailed description thereof will be omitted.

Referring to FIG. 6, the pixel 140' according to another embodiment of the present invention includes an organic light emitting diode (OLED) and a pixel circuit 142' for controlling the amount of current supplied to the OLED.

The pixel circuit 142' includes a second transistor M2' coupled between the second electrode of the first transistor M1 and the data line Dm, a third transistor M3' coupled between a second electrode of the second transistor M2' and the gate electrode of the first transistor M1, and a fourth transistor M4' coupled between the gate electrode of the first transistor M1 and the first electrode of the first transistor M1.

The second transistor M2' is turned on when the first scan signal is supplied to the first scan line S1*n* to electrically couple the data line Dm to the second electrode of the first transistor M1.

The fourth transistor M4' is turned on when the first scan signal is supplied to the first scan line S1*n* to electrically couple the gate electrode of the first transistor M1 to the first electrode of the first transistor M1. That is, when turned on, the fourth transistor M4' couples the first transistor M1 in the form of a diode.

The third transistor M3' is turned on when the second scan signal is supplied to the second scan line S2*n* to electrically couple the second electrode of the first transistor M1 to the gate electrode of the first transistor M1. That is, the third transistor M3' supplies the data signal from the data line Dm to the gate electrode of the first transistor M1.

As described above, the pixel circuit 142' according to the present embodiment is actually the same as the pixel circuit 142 illustrated in FIG. 2 with the exception of the diode type (e.g., the diode-type connection, or the ability to be diode-coupled) of the first transistor M1.

That is, the pixel circuit 142 illustrated in FIG. 2 couples the gate electrode of the first transistor M1 to the second electrode of the first transistor M1 (e.g., via fourth transistor M4) to couple the first transistor M1 in the form of a diode. In this case, the second transistor M2 is coupled between the data line Dm and the first electrode of the first transistor M1 so that the data signal whose threshold voltage is compensated may be supplied to the gate electrode of the diode-coupled first transistor M1.

In the pixel circuit 142' illustrated in FIG. 6, however, the gate electrode of the first transistor M1 is coupled to the first electrode of the first transistor M1 (e.g., via fourth transistor M4) to couple the first transistor M1 in the form of a diode. In this case, the second transistor M2 is coupled between the data line Dm and the second electrode of the first transistor M1 so that the data signal whose threshold voltage is compensated may be supplied to the gate electrode of the diode-coupled first transistor M1.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a scan driver for supplying a first scan signal to first scan lines, for supplying a second scan signal to second scan lines, and for supplying emission control signals to emission control lines;

a data driver for supplying data signals to data lines;

horizontal power source lines extending in parallel with the first scan lines at horizontal lines, and configured to receive a fourth voltage in a first period of a first scan signal period in which the first scan signal is supplied, and configured to receive a third voltage only in a second period excluding the first period, the third voltage being lower than the fourth voltage;

a first power source line coupled to a third power source for supplying the third voltage;

a second power source line coupled to a fourth power source for supplying the fourth voltage;

first switching elements coupled between the first power source line and the horizontal power source lines;

second switching elements coupled between the second power source line and the horizontal power source lines; and pixels positioned at crossing regions of the first scan lines and the data lines, wherein each of the pixels comprises:

an organic light emitting diode (OLED);

a first transistor for controlling an amount of current that flows from a first power source to a second power source via the OLED in accordance with the data signals; and a storage capacitor coupled between a gate electrode of the first transistor and a corresponding one of the horizontal power source lines, wherein the first scan signal is supplied for an entirety of the first scan signal period, wherein a second switching element from among the second switching elements positioned at an $i^{th}$ (i is a natural number) horizontal line of the horizontal lines is configured to be turned on for the first period, and wherein a first switching element from among the first switching elements positioned at the $i^{th}$ horizontal line is configured to be turned on for a time longer than that of the second period and including the second period.

2. The organic light emitting display as claimed in claim 1, wherein the second switching element positioned at the $i^{th}$ horizontal line is configured to be turned on when the second scan signal is supplied to an $i^{th}$ second scan line of the second scan lines.

3. The organic light emitting display as claimed in claim 1, further comprising a switching driver for sequentially supplying control signals to control lines extending in parallel with the first scan lines.

4. The organic light emitting display as claimed in claim 3, wherein the first switching element positioned at the $i^{th}$ horizontal line is configured to be turned on when a control signal of the control signals is supplied to an $i^{th}$ control line of the control lines.

5. An organic light emitting display, comprising:

a scan driver for supplying a first scan signal to first scan lines, for supplying a second scan signal to second scan lines, and for supplying emission control signals to emission control lines;

a data driver for supplying data signals to data lines;

horizontal power source lines extending in parallel with the first scan lines at horizontal lines, and configured to receive a fourth voltage in a first period of a period in which the first scan signal is supplied, and configured to receive a third voltage that is lower than the fourth voltage in a second period excluding the first period; and pixels positioned at crossing regions of the first scan lines and the data lines, wherein each of the pixels comprises:

an organic light emitting diode (OLED);

a first transistor for controlling an amount of current that flows from a first power source to a second power source via the OLED in accordance with the data signals;

a storage capacitor coupled between a gate electrode of the first transistor and a corresponding one of the horizontal power source lines;

a second transistor and a third transistor that are serially coupled between a first electrode of the first transistor and the horizontal power source lines and are configured to be turned off when an emission control signal of the emission control signals is supplied; and a fourth transistor coupled between a second electrode of the first transistor and the OLED and configured to be turned off when the emission control signal is supplied.

6. The organic light emitting display as claimed in claim 5, wherein the first power source is coupled to a common node between the second transistor and the third transistor.

7. The organic light emitting display as claimed in claim 5, wherein each of the pixels further comprises:

a fifth transistor coupled between the first electrode of the first transistor and a data line of the data lines and configured to be turned on when the first scan signal is supplied;

a sixth transistor coupled between the first electrode of the first transistor and the gate electrode of the first transistor and configured to be turned on when the second scan signal is supplied; and a seventh transistor coupled between the gate electrode of the first transistor and the second electrode of the first transistor and configured to be turned on when the first scan signal is supplied.

* * * * *